US005227575A

United States Patent [19]

Mishima

[11] Patent Number: 5,227,575

[45] Date of Patent: Jul. 13, 1993

[54] MUSICAL TONE CONTROL APPARATUS IN ELECTRONIC MUSICAL INSTRUMENT

[75] Inventor: Junichi Mishima, Hamamatsu, Japan

[73] Assignee: Yamaha Corporation, Hamamatsu, Japan

[21] Appl. No.: 661,831

[22] Filed: Feb. 26, 1991

[30] Foreign Application Priority Data

Feb. 26, 1990 [JP] Japan ..... 2-45266

[51] Int. Cl.[5] ..... G10H 1/32; G10H 5/00

[52] U.S. Cl. ..... 84/670; 84/743

[58] Field of Search ..... 84/600, 644, 670, 718, 84/743, 422.4

[56] References Cited

U.S. PATENT DOCUMENTS 4,904,222 2/1990 Gastgeb et al. ..... 84/422.4 X 4,998,457 3/1991 Suzuki et al. ..... 84/600

*Primary Examiner*—Stanley J. Witkowski

*Attorney, Agent, or Firm*—Graham & James

[57] ABSTRACT

A musical tone control apparatus in an electronic musical instrument having a hollow body portion for controlling a musical tone or musical tone factors to be generated in accordance with operation of the player. The control apparatus includes a flexible cord contained within the body portion of the instrument to be drawn outwardly from a hole in a peripheral wall of the body portion and being applied thereon with a load to be drawn into the body portion after drawn outwardly, an operation knob connected to an outer end of the cord and being maintained in engagement with the hole of the body portion for restricting retraction of the cord into the body portion against the load acting thereon, an electric detection device for detecting movement of the cord caused by manipulation of the operation knob and for producing an electric signal indicative of the movement of the cord, and a tone control device responsive to the electric signal for controlling a musical tone or musical tone factors to be generated in accordance with the movement of the flexible cord.

12 Claims, 11 Drawing Sheets

MUSICAL TONE CONTROL APPARATUS IN ELECTRONIC MUSICAL INSTRUMENT

BACKGROUND OF THE INVENTION

1. Field of the Invention

The present invention relates to electronic musical instruments, more particularly to a musical tone control apparatus in the electronic musical instrument for controlling a musical tone or musical tone factors to be generated in accordance with operation of the player.

2. Discussion of the Prior Art

For control of a musical tone or musical tone facters to be generated, there have been provided a slide-volume, a wheel or a joy-stick to be manipulated, a depression pedal or a knee lever to be operated by the player's leg, a mouth controller to be operated by breath pressure of the player or the like. In U.S. Pat. No. Re. 31,019 reissued on Aug. 31, 1982, there has been proposed a stringless electronic musical instrument resembling a guitar that is played like a guitar and sounds like a guitar. It is, however, stringless and has a plurality of flexible actuator blade type members which are adapted to be strummed or picked.

SUMMARY OF THE INVENTION

A primary object of the present invention is to provide a musical tone control apparatus for the electronic musical instrument capable of controlling a musical tone or musical tone factors to be generated in accordance with operation of the player in a novel performance manner.

A secondary object of the present invention is to provide a musical tone control apparatus for the electronic musical instrument adapted to be played like a violin, a viola, a violoncello, a double bass or the like without using a conventional bow.

According to the present invention, the objects are attained by providing a musical tone control apparatus in an electronic musical instrument having a hollow body portion, which apparatus comprises a flexible cord such as a string, a belt, a wire or the like contained within the body portion of the musical instrument to be drawn outwardly from a hole in a peripheral wall of the body portion, loading means provided within the interior of the body portion to apply a load on the flexible cord for drawing it into the body portion, an operation knob connected to an outer end of the flexible cord and being maintained in engagement with the hole of the body portion for restricting retraction of the flexible cord into the interior of the body portion against the load acting thereon, detection means for detecting movement of the flexible cord caused by manipulation of the operation knob and for producing an electric signal indicative of the movement of the cord, and tone control means responsive to the electric signal from the detection means for controlling a musical tone or musical tone factors to be generated in accordance with the movement of the flexible cord.

In an aspect of the present invention, the flexible cord has an inner end suspended from the peripheral wall of the body portion, the loading means comprises a gondola box having a pulley rotatably carried by the flexible cord and a spring connected at its one end to the gondola box and at its other end to the peripheral wall of the body portion for applying a load on the flexible cord, and the detection means comprises at least one of a first sensor arranged within the body portion to detect a displaced position of the flexible cord, a second sensor arranged within the body portion to detect a displacement speed of the flexible cord, and a third sensor arranged within the body portion to detect a displacement direction of the flexible cord.

BRIEF DESCRIPTION OF THE DRAWINGS

Other objects, features and advantages of the present invention will be more readily appreciated from the following detailed description of preferred embodiments thereof when taken together with the accompanying drawings, in which.

DESCRIPTION OF THE PREFERRED EMBODIMENTS

Figure 1:
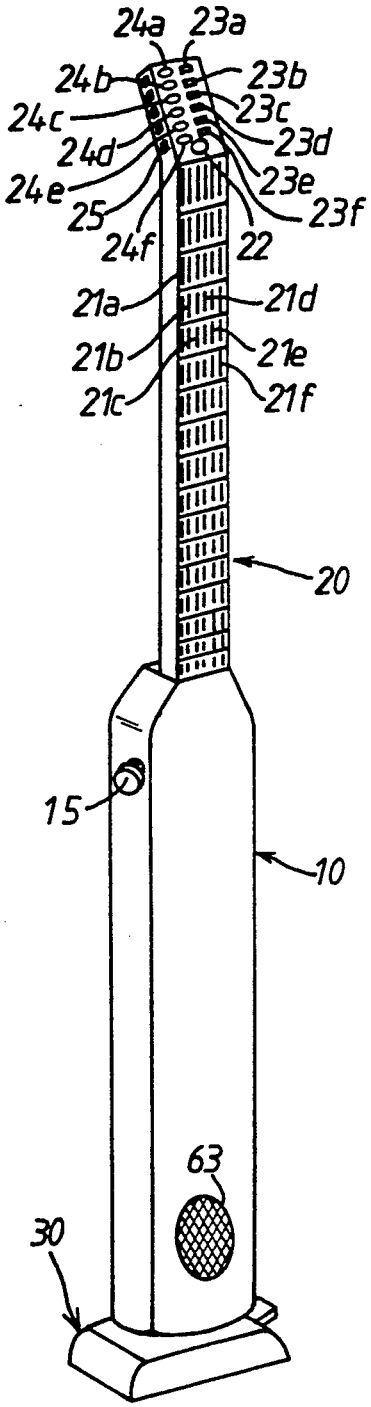
FIG. 1 is a perspective view of a stringless electronic musical instrument in accordance with the present invention.
Figure 3:
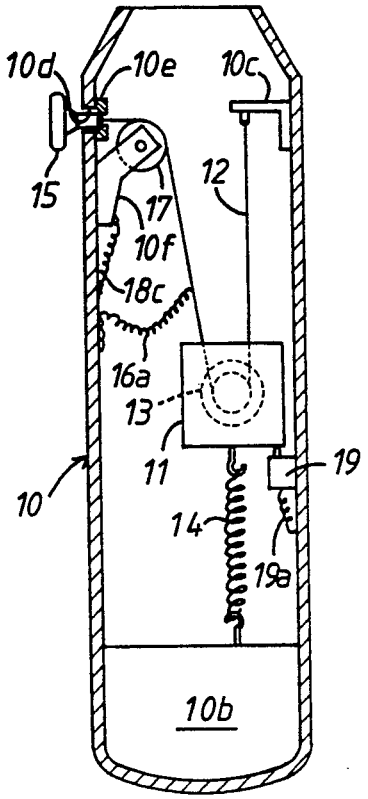
FIG. 3 is a vertical sectional view of a hollow body portion of the musical instrument shown in FIG. 1.
Figure 4:
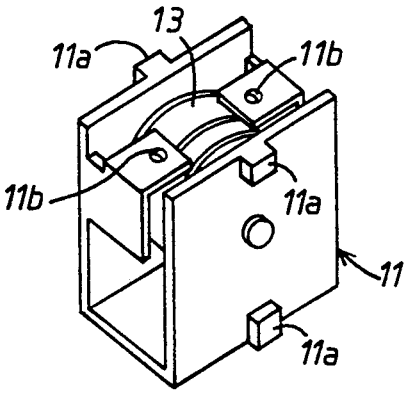
FIG. 4 is a perspective view of a gondola box assembly shown in FIG. 3.
Figure 5:
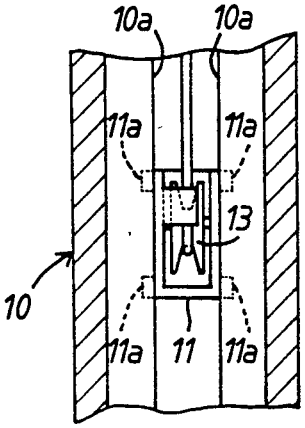
FIG. 5 is an enlarged sectional view of an arrangement of the gondola box assembly in the body portion of the musical instrument.
Figure 6:
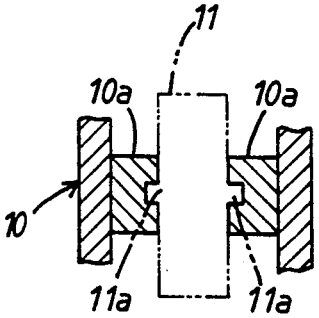
FIG. 6 is an enlarged cross-sectional view of the body portion of the musical instrument showing a pair of opposed vertical guide members for the gondola box assembly.

Referring now to the drawings, FIG. 1 illustrates a stringless electronic musical instrument adapted to be played like a violoncello or a double bass without using a conventional bow. The musical instrument has a hollow body portion 10 and an elongated neck portion 20 secured at its lower end to an upper end of the body portion 10. As shown in FIG. 3, a gondola box 11 is suspended by a string (or wire) 12 within the body portion 10 to be moved upward or downward. As shown in FIG. 4, the gondola box 11 has a pair of opposed side walls each formed with a plurality of projections 11*a* which are slidably engaged with a pair of opposed vertical guide members 10*a* each secured to an internal surface of the body portion 10 as shown in FIGS. 5 and 6. A pulley 13 is rotatably mounted within the gondola box 11 and received by an intermediate portion of the string 12. As shown in FIG. 4, the gondola box 11 has a pair of laterally spaced lugs formed with holes 11*b* through which the string 12 is extended upward. A coil spring 14 is connected at its upper end to the bottom of gondola box 11 and at its lower end to the bottom of the body portion 10 to bias the gondola box 11 downward. In a practical embodiment, the gondola box 11 may be loaded downward by a weight element mounted thereon without providing the coil spring 14.

Figure 7:
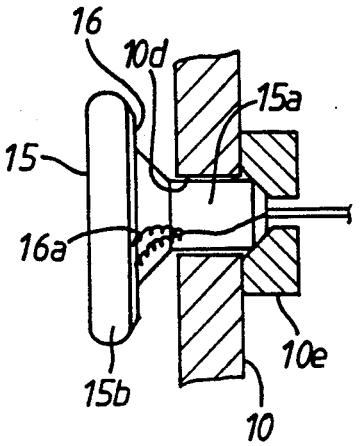
FIG. 7 is an enlarged sectional view showing an operation knob supported in an upper side wall of the body portion.

The string 12 has an inner end fixed to a bracket 10*c* and an outer end extended to the exterior through a lateral hole 10*d* in an upper side wall of body portion 10. The bracket 10*c* is secured to an internal surface of an upper side wall of body portion 10 at a position facing the lateral hole 10*d*. An operation knob 15 is connected to the outer end of string 12 to be gripped by the player's fingers. The operation knob 15 has a leg portion 15*a* fixed to the string 12 and a head portion 15*b* formed to be gripped by the player's fingers. As shown in FIG. 7, the leg portion 15*a* of knob 15 is engaged at its inner end with a retainer member 10*e* which is secured to an internal surface of the upper side wall in surrounding relationship with the lateral hole 10*d* to receive the load acting on string 12. The head portion 15*b* of knob 15 is provided at its bottom with a pressure sensor 16 which is arranged to detect a pressure applied thereto and to issue an analogue signal indicative of the detected pressure through lead wires 16*a*.

Figure 8:
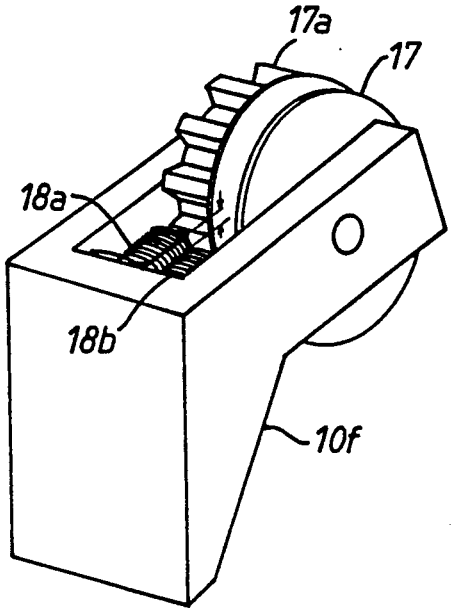
FIG. 8 is an enlarged perspective view of a guide pulley assembled with a rotary encoder mounted within an upper part of the body portion.

As shown in FIGS. 3 and 8, the string 12 is received by a guide pulley 17 at its intermediate portion, and the guide pulley 17 is rotatably mounted on a support bracket 10*f* secured to an internal surface of the side wall at a position below the lateral hole 10*d*. A toothed wheel 17*a* is fixed to one side of the pulley 17 for rotation therewith and opposed to a pair of pick-up coils 18*a*, 18*b* which are fixedly mounted on the support bracket 10*f* at respective positions displaced from one another with one fourth each tooth pitch of the wheel 17*a* to detect rotary movement of the wheel 17*a* and to issue an electric signal indicative of the detected rotary movement through lead wires 18*c*. In this case, a rotary encoder is composed of the pick-up coils 18*a*, 18*b* cooperable with the toothed wheel 17*a*. In a practical embodiment, the toothed wheel 17*a* may be replaced with a pair of toothed wheels the phase of which is displaced at an angle of ninety degree. In such a case, the pick-up coils 18*a*, 18*b* are arranged at the same level in height.

As shown in FIG. 3, a detection switch 19 in the form of a microswitch is fixed to a lower internal surface of the side wall to issue an electric position signal therefrom through a lead wire 19*a*. When the gondola box 11 and string 12 each are in a standard position in which the knob 15 is maintained in engagement with the retainer member 10*e* at its leg portion 15*a*, the detection switch 19 is closed by engagement with the bottom surface of gondola box 11. When the gondola box 11 is moved upward, the detection switch 19 is opened. As shown in FIG. 1, the neck portion 20 of the electronic musical instrument is provided thereon with a plurality of fret switches 21*a*–21*f* which are embedded in a finger board of the neck portion 20 in such a manner as to be partly exposed upward. The fret switches 21*a*–21*f* are vertically arranged in parallel to one another to correspond with strings of a conventional stringed musical instrument. That is, the fret switches 21*a*–21*f* are arranged in the form of a plurality of touch switches which are selectively touched by the player's finger to designate a desired scale of a musical tone to be generated.

The neck portion 20 of the musical instrument is further provided at its upper end portion with a mode selector 22, a series of pitch-change selectors 23*a*–23*f* and a series of pitch control tuners 24*a*–24*f* and is provided at its upper side portion with a series of tone-color control selectors 25. The mode selector 22 is arranged to be selectively switched over among three positions. That is, the mode selector 22 is operable among a first position in which it acts to select a first mode for setting a desired scale (for instance, a temperament scale) of all musical tones to be generated, a second position in which it acts to select a second mode for uniformly changing the scale of all the musical tones by an adjusted pitch and a third position in which it acts to select a third mode for changing the respective scales of the musical tones by an adjusted pitch at each series of fret switches 21*a*–21*f*. The series of pitch-change selectors 23*a*–23*f* are arranged to be activated only in a condition where the third mode has been selected at the mode selector 22. When activated, the pitch-change selectors 23*a*–23*f* act to set the desired scale of the musical tones respectively at the fret switches 21*a*–21*f* or change the scale of the musical tones by an adjusted pitch.

The pitch control tuners 24*a*–24*f* are arranged to be activated only in a condition where the third mode has been selected at the mode selector 22. When activated, the pitch control tuners 24*a*–24*f* act to control the pitch of the musical tones respectively at the fret switches 21*a*–21*f*. In this case, only the pitch control tuner 24*a* acts to control the pitch of all the musical tones in a condition where the second mode has been selected at the mode selector 22. Furthermore, the pitch control tuners 24*a*–24*f* are designed to slightly adjust the pitch in an extent of about one octave and are each provided with a click mechanism for changing the musical tones respectively at one scale (100 cent). The tone-color control selectors 25 are designed to select a tone-color, a tone volume, a sound effect or the like respectively at the fret switches 21*a*–21*f*.

Figure 9:
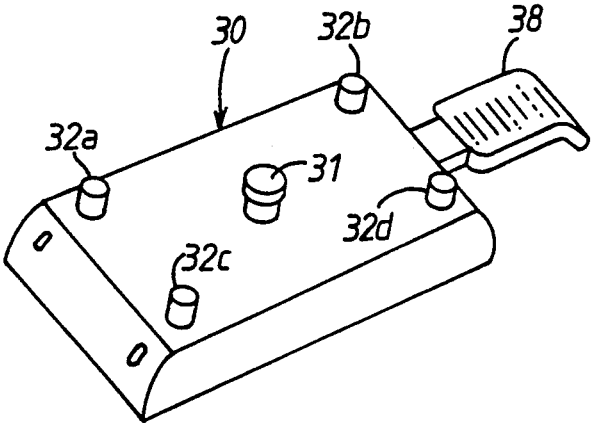
FIG. 9 is an enlarged perspective view of a support table of the musical instrument shown in FIG. 1.
Figure 10:
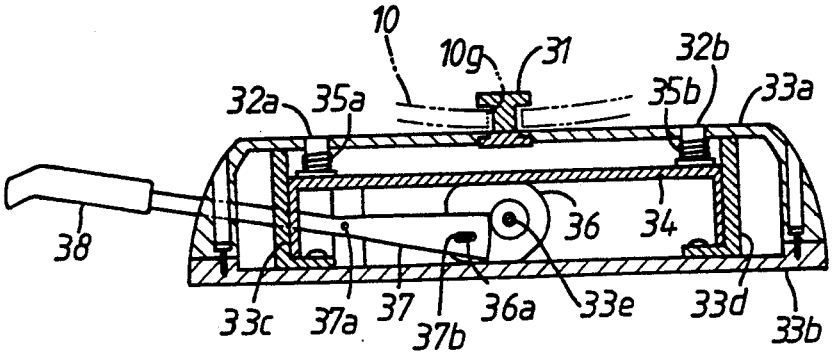
FIG. 10 is an enlarged sectional view of the support table shown in FIG. 9.

As shown in FIG. 1, the electronic musical instrument is placed on a support table 30 at its body portion 10. As shown in FIG. 9, the support table 30 is provided thereon with a retainer pin 31 and support pins 32*a*–32*d* which are arranged to tiltably support thereon the body portion 10 of the musical instrument. As shown in FIGS. 9 and 10, the retainer pin 31 is secured at its lower end to an upper cover member 33*a* of support table 30 in such a manner that a head portion of pin 31 is projected upward to be engaged with a vertical hole 10g in the bottom wall of body portion 10 of the instrument. For engagement with the head portion of pin 31, the bottom wall of body portion 10 is formed with a lateral slot (not shown) through which the head portion of pin 31 is inserted and moved to be engaged with the vertical hole 10g. The support pins 32a–32d are mounted on a movable plate 34 which is slidably supported by a pair of opposed guide members 33c, 33d fixed to a bottom plate 33b of table 30. The support pins 32a–32d are biased downward by means of coil springs 35a–35d to be retracted when the movable plate 34 is retained in a lower position under the load of springs 35a–35d and to be projected upward when the movable plate 34 is lifted up against the load of springs 35a–35d. The movable plate 34 is engaged at its bottom surface with a cam member 36 which is rotatably mounted on a support shaft 33e within the table housing. A lever 37 is arranged to be rotated about a pivot pin 37a, and a pedal 38 is secured to an outer end of lever 37. The level 37 has an inner end portion formed with an elongated hole 37b in engagement with a pin 36a eccentrically fixed to the cam member 36. The lever 37 is further arranged to be retained in an upper position or a lower position by means of a lock mechanism (not shown).

Figure 2:
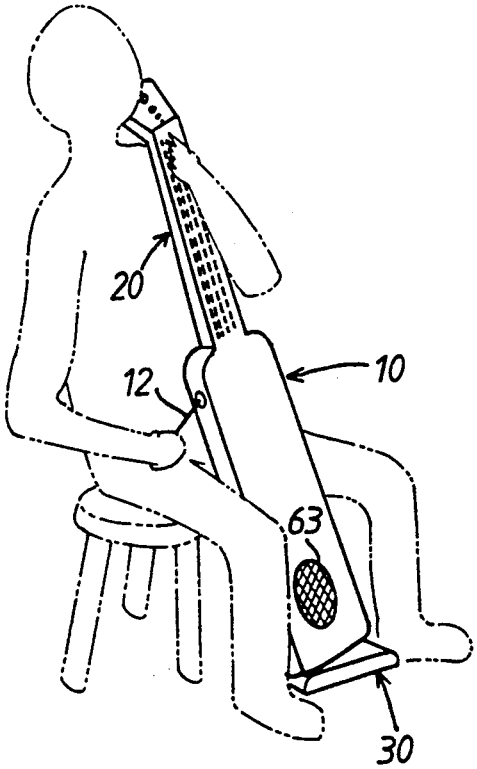
FIG. 2 is a perspective view of the musical instrument used to be played like a violoncello or a double bass.

When the pedal 38 is depressed in a condition where the body portion 10 of the musical instrument is maintained in engagement with the retainer pin 31 at its bottom hole 10g, the inner end portion of lever 37 is raised to rotate the cam member 36, and in turn, the movable plate 34 is raised to project the support pins 32a–32d. Thus, the body portion of the musical instrument is carried by the support pins 32a–32d in a vertical direction. When the pedal 38 is raised to rotate the cam member 36, the movable plate 34 is moved downward to retract the support pins 32a–32d, and in turn, the body portion 10 of the musical instrument is separated from the support pins 32a–32d to be tiltably supported on the table 30 as shown in FIG. 2.

Figure 11A:
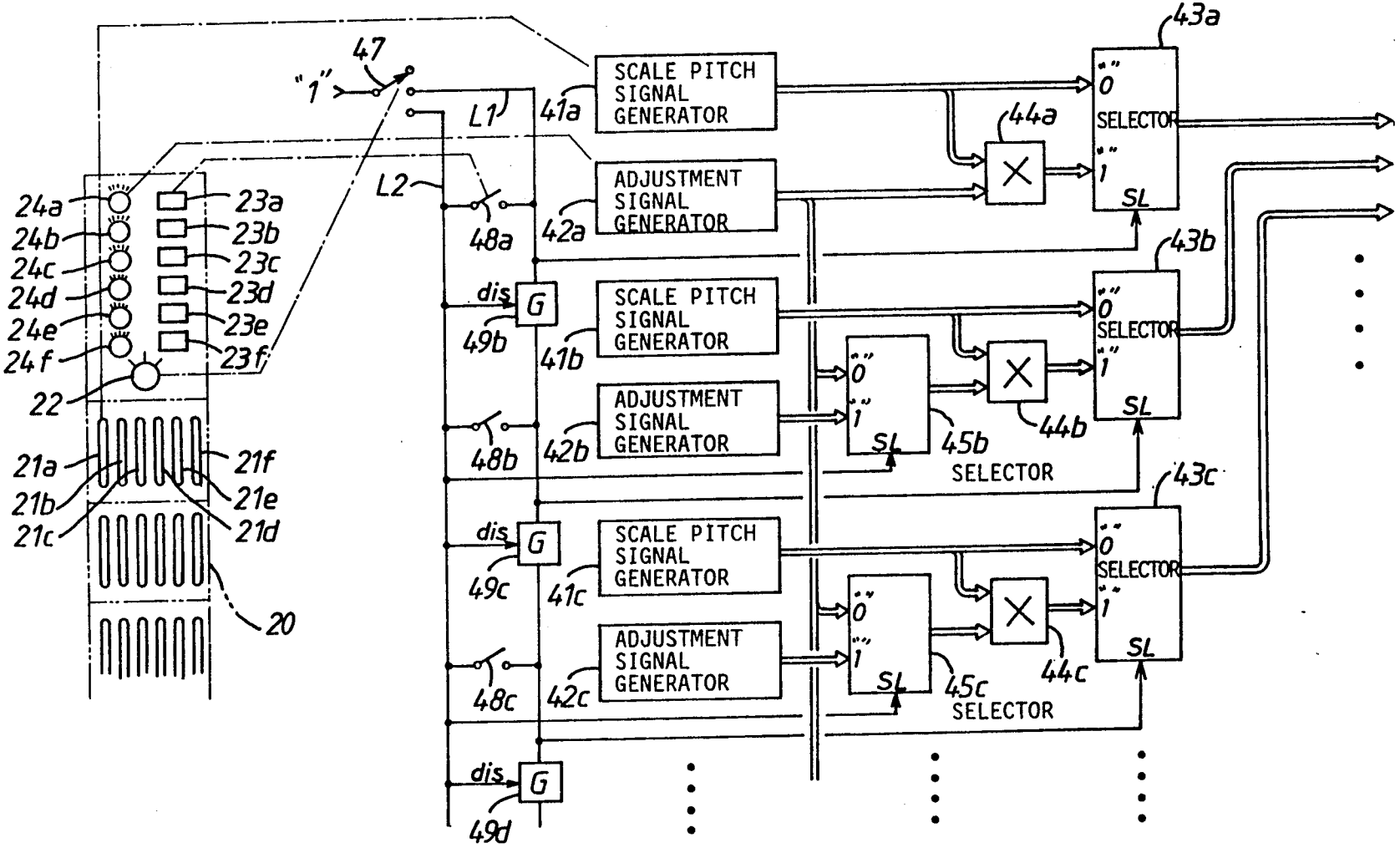
FIGS. 11(*a*) and 11(*b*) illustrate an electronic tone control apparatus for the musical instrument shown in FIG. 1.
Figure 11B:
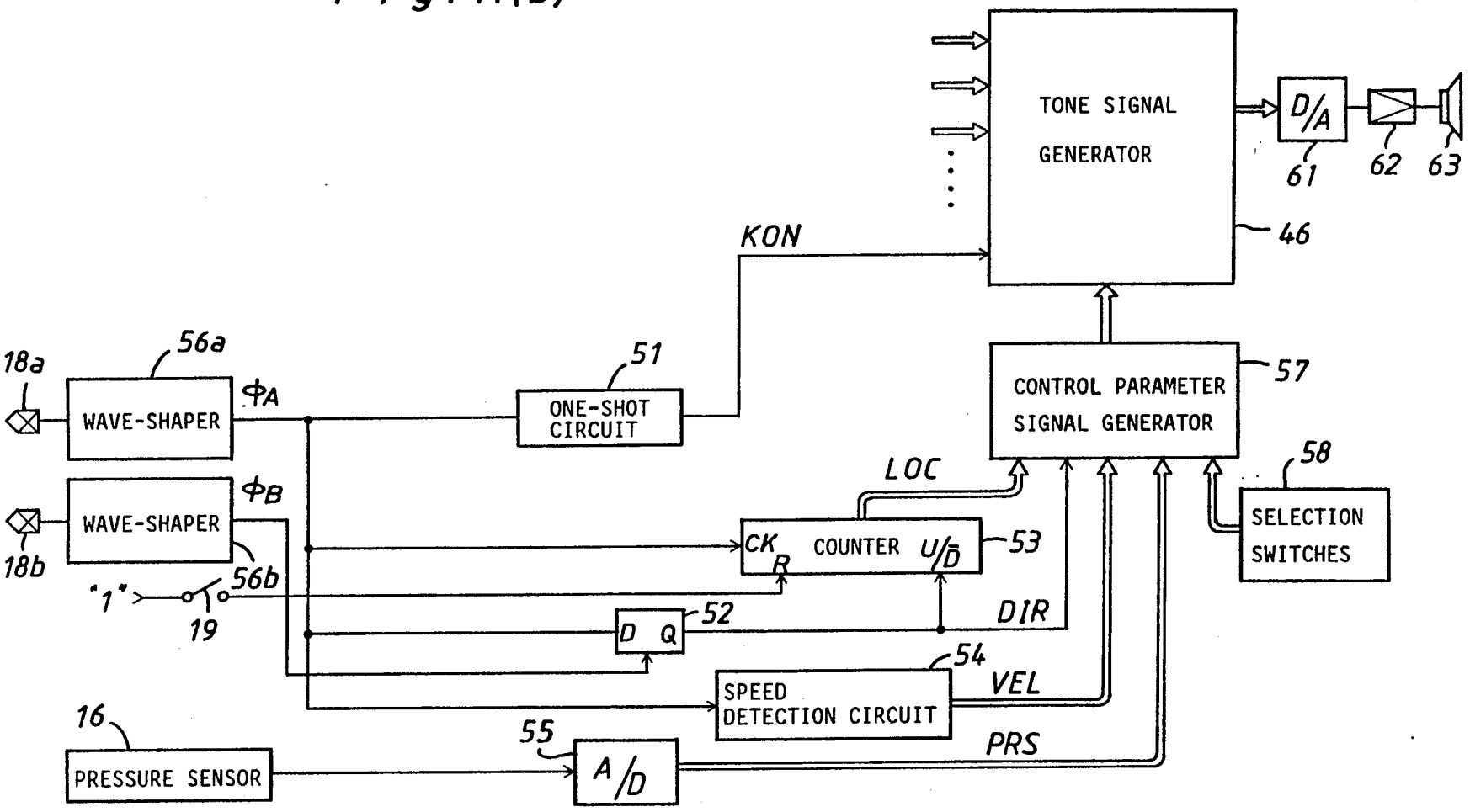

Hereinafter, an electronic tone control apparatus assembled within the bottom of the body portion 10 will be described with reference to FIGS. 11(*a*) and 11(*b*). As shown in FIG. 11(*a*), the electronic tone control apparatus includes a series of scale pitch signal generators 41a, 41b, 41c, . . . 41f and a series of pitch adjustment signal generators 42a, 42b, 42c, . . . 42f. The scale pitch signal generators 41a, 41b, 41c, . . . 41f are arranged to cooperate with each series of the fret switches 21a–21f. When the fret switches 21a–21f are operated by the player's fingers, the scale pitch signal generators 41a, 41b, 41c . . . 41f are activated to produce digital signals indicative of pitch data proportinal to each pitch frequency of the fret switches and to apply the digital signals to a series of selectors 43a, 43b, 43c . . . 43f and a series of multipliers 44a, 44b, 44c . . . 44f. The pitch adjustment signal generators 42a, 42b, 42c . . . 42f are arranged to cooperate with the pitch control tuners 24a–24f. When the pitch control tuners 24a–24f are adjusted, the pitch adjustment signal generators 42a–42f are activated to produce digital signals respectively indicative of an adjusted pitch. The digital signal from signal generator 42a is applied to the multiplier 44a and to selectors 45b, 45c, . . . 45f. The digital signals from pitch adjustment signal generators 42b, 42c, . . . 42f are applied to the selectors 45b, 45c, . . . 45f, respectively.

The selectors 45b, 45c, . . . 45f are arranged to apply the digital signal from the pitch adjustment signal generator 42a to the multipliers 44b, 44c, . . . 44f when applied with the digital signal at a low level "0" and to apply the digital signals from the pitch adjustment signal generators 42b, 42c, . . . 42f to the multipliers 44b, 44c, . . . 44f when applied with the digital signals at a high level "1". When applied with the digital signals from the signal generators 41a–41f and 42a–42f, each of the multipliers 44a, 44b, 44c . . . 44f multiplies the scale pitch data by the adjusted pitch and applies a digital signal indicative of the resultant of the multiplication to the selectors 43a, 43b, 43c, . . . 44f. The selectors 43a, 43b, 43c, . . . 43f are arranged to apply the scale pitch data to a tone signal generator 46 when applied with the digital signals from the scale pitch signal generators 41a, 41b, 41c, . . . at a low level "0" and to apply the resultant of the multiplication to the tone signal generator 46 when applied with the digital signals from the multipliers 44a, 44b, 44c, . . . 44f respectively at a high level "1".

The selectors 43a, 43b, 43c, . . . 43f are connected to a pitch-change mode switch 47 and a series of pitch-change selection switches 48a, 48b, 48c, . . . 48f to be applied with a high level signal "1" or a low level signal "0" in response to operation of the switches 47 and 48a–48f. The pitch-change mode switch 47 is arranged to cooperate with the mode selector 22. When the mode selector 22 is set in the first position, the mode switch 47 is retained in an open position to maintain each level of signal lines L1, L2 at a low level "0". When the mode selector 22 is set in the second position, the mode switch 47 is connected to the line L1 to maintain the level of signal line L1 at a high level "1" and to maintain the level of signal line L2 at a low level "0". When the mode selector 22 is set in the third position, the mode switch 47 is connected to the signal line L2 to maintain the level of signal line L1 at a low level "0" and to maintain the level of signal line L2 at a high level "1".

The pitch-change selection switches 48a, 48b, 48c, . . . 48f are interposed between the signal lines L1 and L2 to cooperate with the pitch-change selectors 23a–23f. The selection switches 48a–48f are connected to the selectors 43a, 43b, . . . 43f at their connection points with the signal line L1. The signal line L1 is provided with bidirectional gate circuits 49b, 49c, 49d, . . . 49f respectively between the pitch-change selection switches 48a, 48b, 48c, . . . 48f. The gate circuits 49b, 49c, 49d, . . . 49f are normally maintained in an energized condition to provide a common connection of the signal line L1 and act to separate the signal line L1 therein when deenergized in response to a high level signal "1" applied thereto from the signal line L2. In addition, the selectors 45b, 45c, . . . 45f are connected to the signal line L2.

Figure 14A:
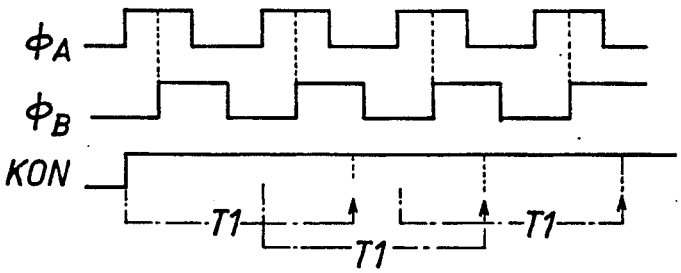
FIGS. 14(*a*), 14(*b*), 15(*a*) and 15(*b*) each are a time chart for explaining operation of the speed detection circuit shown in FIGS. 12 and 13.
Figure 14B:
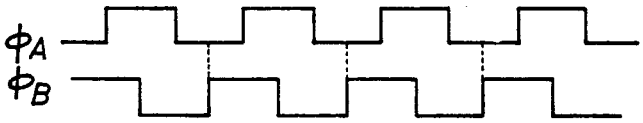

As shown in FIG. 11(*b*), the electronic tone control apparatus further includes a one-shot circuit 51, a delay flip-flip 52, an up-and-down counter 53, a speed detection circuit 54 and an analogue-to-digital or A/D converter 55. The one-shot circuit 51 is in the form of a mono-stable multivibrator connected to the pick-up coil 18a through a wave shaper 56a which is arranged to reshape a sine wave signal from the pick-up coil 18a into a rectangular wave signal $\phi_A$. As shown in FIG. 14(*a*), an output signal of the one-shot circuit 51 is normally maintained at a low level and becomes a high level "1" at a leading edge of the rectangular wave signal $\phi_A$ applied from the wave shaper 56a. After lapse of a time T1, the output signal of one-shot circuit 51 becomes a low level "0". Assuming that the pulley 17 is being rotated by continuous movement of the string 12, the one-shot circuit 51 produces a high level signal therefrom in response to the rectangular wave signal $\phi_A$ applied thereto from the pick-up coil 18a through the wave shaper 56a. The high level output signal of one-shot circuit 51 is applied as a key-on signal KON to the tone signal genertor 46. The delay flip-flop 52 is applied with the rectangular wave signal $\phi_A$ from the wave shaper 56a and a rectangular wave signal $\phi_B$ from the pick-up coil 18b through a wave shaper 56b to issue the rectangular wave signal $\phi_A$ therefrom at a leading edge of the rectangular wave signal $\phi_B$. Assuming that the string 12 has been drawn outwardly from the body portion 10 of the musical instrument to rotate the pulley 17 in a forward direction, the delay flip-flop 52 produces a high level signal "1" therefrom in response to rectangular wave signals $\phi_A$, $\phi_B$ applied thereto from the pick-up coils 18a, 18b respectively through the wave shapers 56a, 56b as shown in FIG. 14(*a*). When the string 12 has been drawn into the body portion 10 of the musical instrument to rotate the pulley 17 in a reserve direction, the delay flip-flop 52 produces a low level signal "0" therefrom in response the rectangular wave signals $\phi_A$, $\phi_B$ applied thereto from the pick-up coils 18a, 18b through the wave shapers 56a, 56b as shown in FIG. 14(*b*). Accordingly, the output signal of delay flip-flop 52 represents a displacement direction of the string 12 and is applied as a direction signal DIR to a control parameter signal generator 57.

The up-and-down counter 53 is arranged to be applied with the rectangular wave signal $\phi_A$ from wave shaper 56a as a clock signal and the direction signal DIR from delay flip-flop 52 as a count-direction control signal. The counter 53 acts to count up at each leading edge of the rectangular wave signal $\phi_A$ when the direction signal DIR is maintained at a high level "1" and to count down at each leading edge of the rectangular wave signal $\phi_A$ when the direction signal DIR is maintained at a low level "0". The up-and-down counter 53 has a reset terminal connected to the detection switch 19 mounted within the body portion 10 of the musical instrument. When the operation knob 15 is maintained in engagement with the retainer member 10e to retain the gondola box 11 at the standard position, the detection switch 19 is maintained in a closed position. In such a condition, the count value of counter 53 is maintained to be "0". When the string 12 is drawn outwardly from the body portion 10 to move the gondola 11 upward, the count value of counter 53 increases in accordance with displacement of the string 12. When the string 12 is drawn into the body portion 10 to cause downward movement of the gondola 11, the count value of the counter 53 decreases in accordance with movement of the string 12. Accordingly, the count value of counter 53 represents a displaced position of the string 12 and is applied as a displacement position signal LOC to the control parameter signal generator 57.

Figure 12:
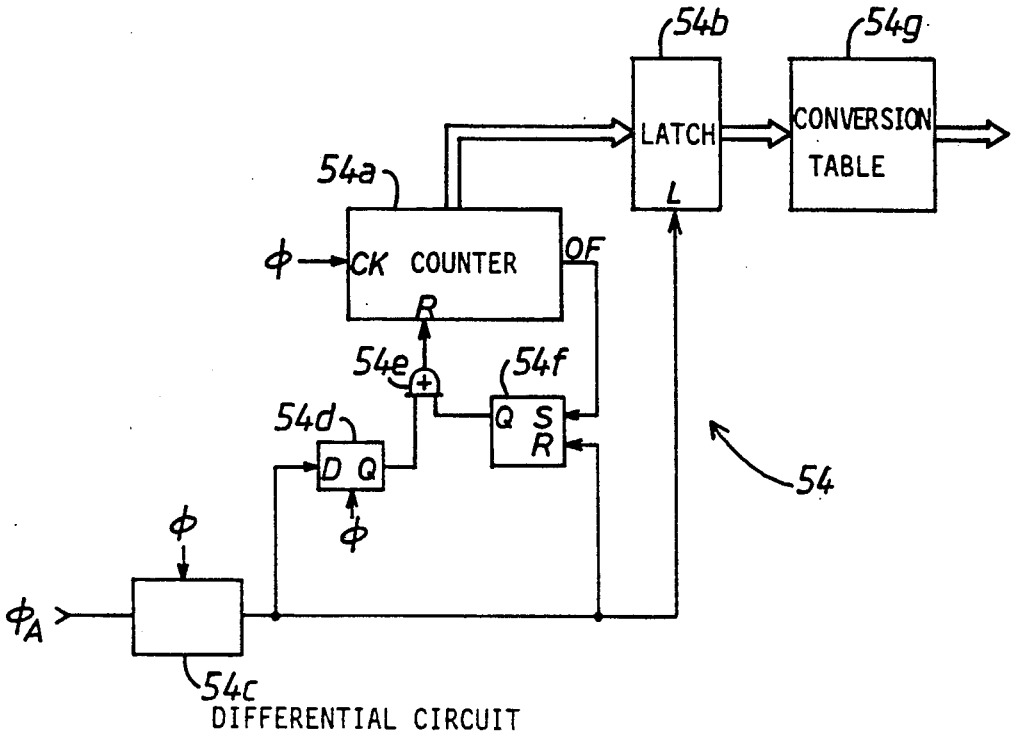
FIG. 12 is a block diagram of a speed detection circuit shown in FIG. 11(*b*)
Figure 15A:
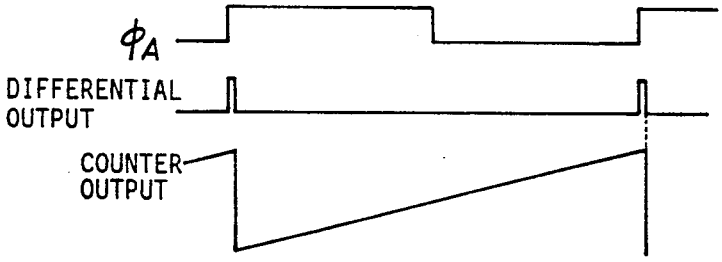
Figure 15B:
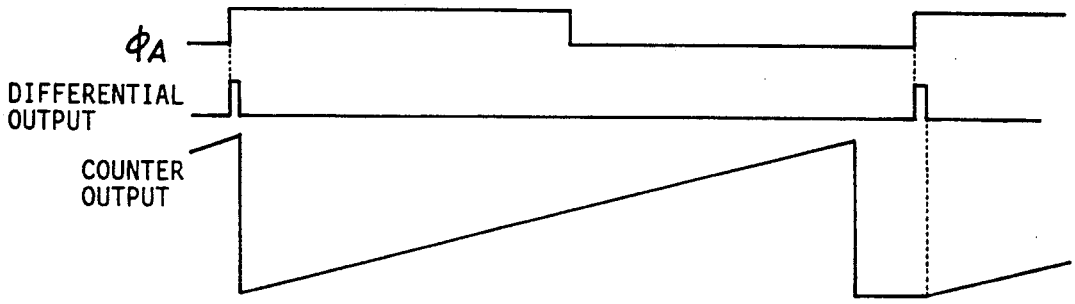
Figure 16A:
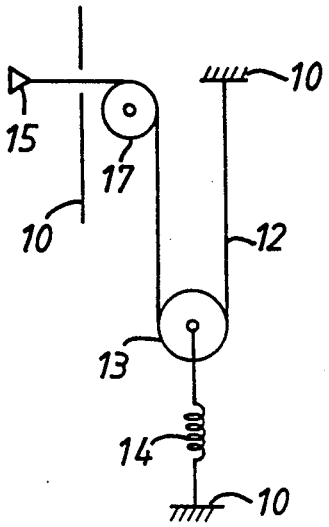
FIGS. 16(*a*) to 16(*e*) illustrate modifications of the string arrangement shown in FIG. 3.
Figure 16B:
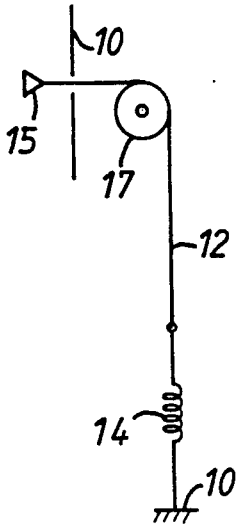
Figure 16C:
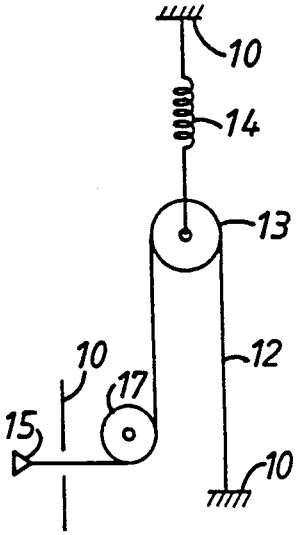
Figure 16D:
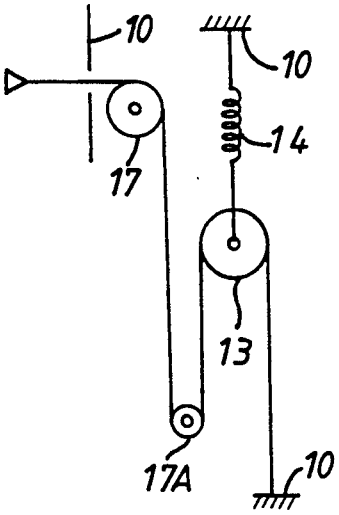
Figure 16E:
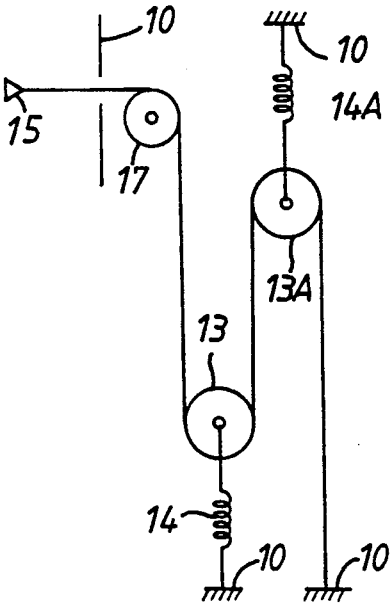

As shown in FIG. 12, the speed detection circuit 54 includes a counter 54a for counting a high speed clock signal $\phi$ applied from a master clock signal generator (not shown) and a latch circuit 54b for latching a count value applied from the counter 54a. The counter 54a has a reset terminal arranged to be applied with the rectangular wave signal $\phi_A$ from wave shaper 56a through a differential circuit 54c, a delay flip-flop 54d and an OR circuit 54e. The latch circuit 54b has an input terminal arranged to be applied with an output signal of the differential circuit 54c. The differential circuit 54c and delay flip-flop 54d are arranged to be applied with the high speed clock signal $\phi$. At each leading edge of the rectangular wave signal $\phi_A$, the differential circuit 54c produces a differential pulse signal the width of which is equal to one period of the clock signal $\phi$. The delay flip-flop 54d issues the pulse signal therefrom with delay of the one period of the clock signal $\phi$. Thus, as shown in FIG. 15(*a*), the counter 54a counts the clock signal $\phi$ for each period of the rectangular wave signal $\phi_A$, and the latch circuit 54b memorizes a time data indicative of the one period renewed at each period of the rectangular wave signal $\phi_A$. In this instance, the rectangular wave signal $\phi_A$ is produced in accordance with displacement of the string 12, and the period of rectangular wave signal $\phi_A$ is inverse proportional to the displacement speed of string 12. Accordingly, the memorized data in latch circuit 54b is inverse proportional to the displacement speed of string 12.

Figure 13:
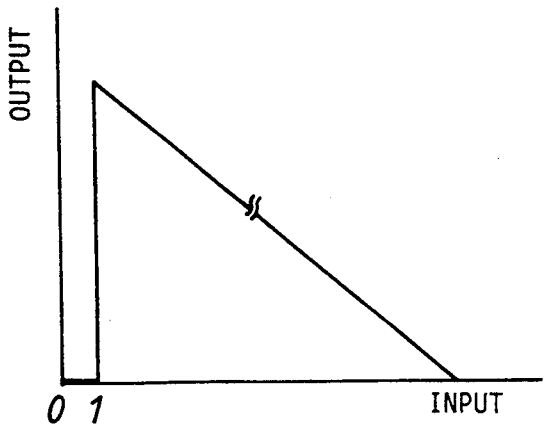
FIG. 13 is a graph showing an input and output conversion characteristic of a conversion table shown in FIG. 12.

The OR circuit 54e is arranged to be applied with an output signal from a flip-flop 54f of the set-reset type. The flip-flop 54f is set in response to an overflow signal OF applied thereto from the counter 54a and is reset in response to the output signal of differential circuit 54c. Assuming that the displacement speed of string 12 is extremely low, the period of rectangular wave signal $\phi_A$ becomes extremely long. In such a condition, as shown in FIG. 15(*b*), the counter 54a is reset and maintained in its reset condition until the level of rectangular wave signal $\phi_A$ becomes a high level. Thus, the latch circuit 54b memorizes data indicative of "0" and applies the memorized data to a conversion table 54g. As shown in FIG. 13, the conversion table 54g is arranged to issue an output signal indicative of "0" when the memorized data is "0" and to issue an output signal the level of which is decreased in accordance with an increase of the memorized data more than "1". Accordingly, the output data of conversion table 54g issued in proportion to the displacement speed of string 12 is applied as a speed data VEL to the control parameter signal generator 57.

The A/D converter 55 is arranged to convert an analogue signal indicative of pressure detected by the pressure sensor 16 into a digital signal PRS and to apply the converted digital signal PRS to the control parameter signal generator 57. The control parameter signal generator 57 is connected to a series of tone-color selection switches 58 which cooperate with the tone-color selectors 25 to produce a selection signal indicative of a tone-color, a tone volume, sound effects or the like selected by operation of the selectors 25 and to apply the selection signal to the control parameter signal generator 57. The control parameter signal generator 57 is responsive to the input signals LOC, DIR, VEL, PRS from the counter 53, flip-flop 52, speed detection circuit 54, A/D converter 55 and the selection signal from the selection switches 58 to produce various parameter for control of musical tones to be generated. The tone signal generator 46 is responsive to the pitch control signals from the selectors 43a–43f and the key-on signal KON from the one-shot circuit 51 to produce a digital musical tone signal in accordance with the various parameter applied from the control parameter signal generator 57. The tone signal generator 46 is connected to a digital-to-analogue or D/A converter 61 which is arranged to convert the digital musical tone signal into an analogue musical tone signal and to apply the converted analogue musical tone signal to a speaker 63 through an amplifier 62. The speaker 63 is assembled within a lower front portion of the body portion 10 of the musical instrument as shown in FIG. 1.

Hereinafter, the mode of operation of the musical instrument will be described. As shown in FIG. 2, the electronic musical instrument is tiltably set by a player by depression of the pedal 38. Assuming that one or more of the fret switches 21*a*–21*f* are touched with the player's finger, the corresponding scale pitch signal generators 41*a*–41*f* are activated to apply pitch data of the touched fret switches to the selectors 43*a*–44*f* and to the multipliers 44*a*–44*f*. When a plurality of fret switches 21*a*–21*f* in the same row are simultaneously operated by the player, only pitch data of the uppermost or lowermost one of the operated fret switches is issued from the corresponding one of scale pitch signal generators 41*a*–41*f*. If the mode selector 22 is set in the first position to retain the pitch-change mode switch 47 in its open position as shown in FIG. 11(*a*), each signal level on lines L1, L2 is maintained to be "0". Thus, the selectors 43*a*–43*f* are activated to apply the pitch data from the scale pitch signal generators 41*a*–41*f* to the tone signal generator 46. In this instance, the tone signal generator 46 produces a musical tone signal the frequency of which corresponds with a scale pitch frequency of the touched fret switch.

If the mode selector 22 is set in the second position, the pitch-change mode switch 47 is connected to the line L1 so that the signal level on line L1 becomes a high level "1" and that the signal level on line L2 is maintained at a low level "0". In such a condition, the gate circuits 49*b*–49*f* are energized, and in turn, the selectors 45*b*–45*f* are activated to apply pitch adjustment data from the pitch adjustment signal generators 42*a* to the multipliers 44*a*–44*f*. Thus, the selectors 43*a*–43*f* apply the resultant data of the multiplication from multipliers 44*a*–44*f* to the tone signal generator 46. In this instance, the tone control signal generator 46 produces a musical tone signal the frequency of which becomes a scale pitch frequency adjusted at the pitch adjustment signal generator 42*a*. The adjustment data from the pitch adjustment generator 42*a* corresponds with an adjusted position of the pitch control tuner 24*a*. This means that the scale pitch frequency is uniformly adjusted in accordance with the adjusted position of the pitch control tuner 24*a*.

If the mode selector 22 is set in the third position, the pitch-change mode switch 47 is connected to the line L2 so that the signal level on line L1 becomes a low level "0" and that the signal level on line L2 becomes a high level "1". In such a condition, the gate circuits 49*b*–49*f* are deenergized, and in turn, the selectors 45*b*–45*f* are activated to apply pitch adjustment data from the pitch adjustment signal generators 42*b*–42*f* to the multipliers 44*b*–44*f*. Assuming that only the pitch-change selection switches 48*a* and 48*b* are closed, the selectors 43*a* and 43*b* are activated to apply the resultant data of the multiplication from multipliers 44*a* and 44*b* to the tone signal generator 46, while the other selectors 43*c*–43*f* are activated to apply the scale pitch data from the scale pitch signal generators 41*c*–41*f* to the tone signal generator 46. In this instance, the tone signal generator 46 produces a musical tone signal the frequency of which becomes a scale pitch frequency adjusted at the pitch adjustment signal generators 42*a* and 42*b* and produces a musical tone signal the frequency of which becomes a scale pitch frequency applied from the scale pitch signal generators 41*c*–41*f*. The adjustment data from pitch adjustment signal generators 42*a* and 42*b* correspond with each adjusted position of the pitch control tuners 24*a* and 24*b*.

When the operation knob 15 is drawn by the player's finger outwardly under such operation of the fret switches 21*a*–21*f* as described above, the string 12 is drawn outwardly from the body portion 10 of the instrument to lift up the gondola box 11 against the biasing force of spring 14. When the operation knob 15 is released by the player's finger, the string 12 is drawn into the body portion 10 under the load of spring 14 to displace the gondola box 11 downward. Thus, the pulley 17 is rotated in a forward or reverse direction in accordance with outward or inward movement of the string 12 caused by manipulation of the operation knob 15. In this instance, the pick-up coils 18*a*, 18*b* produce sine wave signals therefrom at a phase difference of 90 degree, and in turn, the wave shapers 56*a*, 56*b* reshape the sine wave signals into rectangular wave signals $\phi_A$, $\phi_B$. This causes the one-shot circuit 51 to issue a key-on signal KON at a high level "1" and apply it to the tone signal generator 46. When applied with the key-on signal KON, the tone signal generator 46 produces a musical tone signal the frequency of which corresponds with the pitch data applied from the selectors 43*a*–43*f*, and in turn, the speaker 63 is activated to sound a musical tone defined by the musical tone signal applied from the tone signal generator 46. When the operation knob 15 is stopped, the sine wave signals from pick-up coils 18*a*, 18*b* and the rectangular wave signals from wave shapers 56*a*, 56*b* disappear, and in turn, the key-on signal from one-shot circuit 51 becomes a low level "0". This causes the speaker 63 to stop the sound of the musical tone.

During manipulation of the operation knob 15, the rectangular wave signals $\phi_A$, $\phi_B$ are applied to the delay flip-flop 52, up-and-down counter 53 and speed detection circuit 54. At these circuits, the displacement direction, position and speed of the string 21 are detected as various physical amounts and applied to the control parameter signal generator 57. When the pressure sensor 16 is pressed by the player's finger or released from the applied pressure, an electric signal indicative of the applied pressure from sensor 16 is applied to the control parameter signal generator 57 through the A/D converter 55. Additionally, electric signals indicative of a tone-color, a tone volume, a sound effect or the like are applied to the control parameter signal generator 57 from the selection switches 58. When applied with the various physical amounts and the pressure data, the control parameter signal generator 57 produces various parameter signals in response to electric signals indicative of the tone-color, tone volume, sound effect or the like applied from the selection switches 58. When applied with the various parameter signals, the tone signal generator 46 controls musical tone factors of the musical tone signal in accordance with the applied parameters. Thus, the musical tone factors of the musical tone issued from the speaker 63 are controlled in accordance with movement of the string 12 and pressure detected by the pressure sensor 16.

From the above description, it will be understood that in the foregoing embodiment a musical tone or musical tone factors are controlled in accordance with movement of the string 12 caused by manipulation of the operation knob 15. With the electronic musical instrument, a novel performance can be provided by the player. The foregoing embodiment of the present invention can be modified as described below.

1) The fret switches 21*a*–21*f* may be arranged to designate a tone pitch at each operation thereof and to control the generation and stopping of the musical tone.

With such an arrangement, a musical tone is generated by operation of the respective fret switches, and the key-on signal from one-shot circuit 51 can be utilized to control other musical tone factors. 2) In FIG. 16(*a*) there is schematically illustrated the arrangement of the string 12, pulleys 13, 17, spring 14 and operation knob 15 shown in FIG. 3. The arrangement of the string may be modified as shown in FIG. 16(*b*), wherein the string 12 is connected at its inner end to a bottom of the body portion 10 through the spring 14 to be applied thereon with the load of spring 14. In FIG. 16(*c*) there is illustrated another modification of the string arrangement wherein the string 12 is connected at its inner end to a bottom of the body portion 10 whereas the spring 14 is suspended from an upper part of the body portion 10 to bias the pulley 13 upward, and wherein the operation knob 15 and the pulley 17 with the rotary encoder are located below the pulley 13. FIG. 16(*d*) illustrates a further modification of the string arrangement wherein the string 12 is connected at its inner end to a bottom of the body portion 10 whereas the spring 14 is suspended from an upper part of the body portion 10 to bias the pulley 13 upward, and wherein an additional pulley 17A is rotatably carried by an intermediate portion of the string 12. In FIG. 16(*e*) there is illustrated a still further modification of the string arrangement wherein the string 12 is connected at its inner end to a bottom of the body portion 10, and wherein an additional pulley 13A is rotatably carried by an additional spring 14A suspended from an upper part of the body portion 10 to support an intermediate portion of the string 12.

Figure 17:
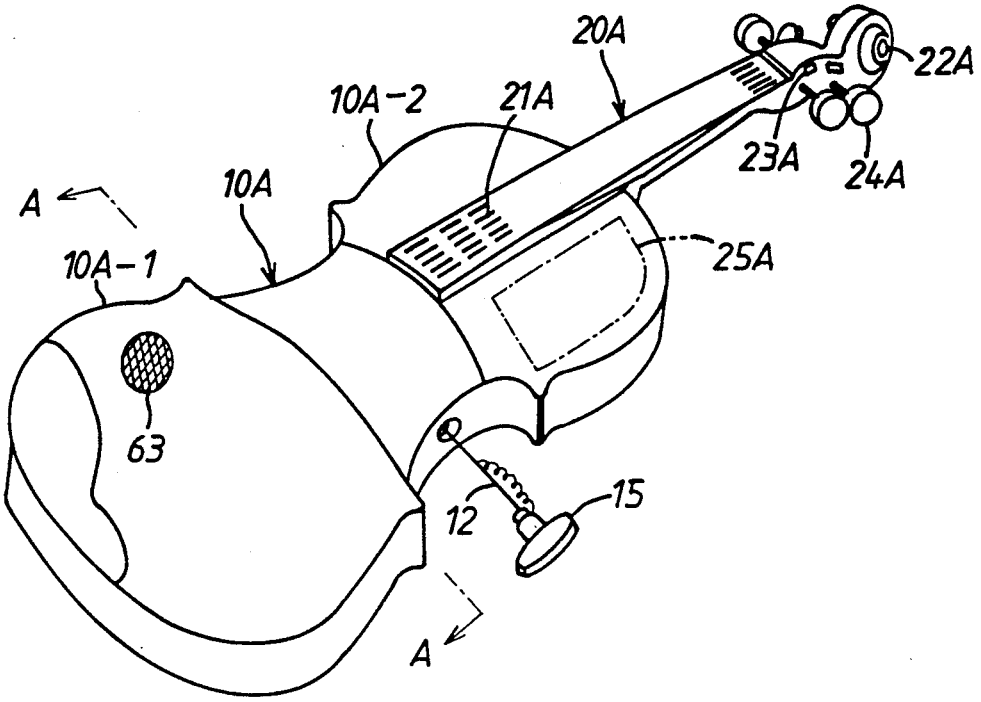
FIG. 17 is a perspective view of a modification of the musical instrument shown in FIG. 1.
Figure 18:
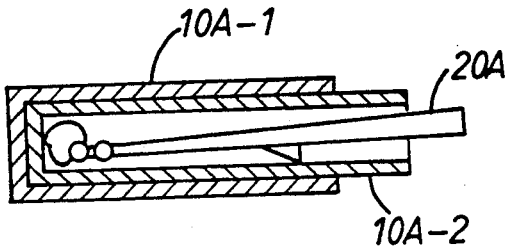
FIG. 18 is a sectional view schematically illustrating a shortened condition of the instrument shown in FIG. 17.

3) Although in the above embodiment the musical instrument has been constructed to be played like a violoncello, a double bass or the like, the present invention may be adapted to an electronic musical instrument which is constructed to be played like a violin, a viola or the like as shown in FIG. 17. The musical instrument of FIG. 17 is composed of a hollow body portion 10A and a neck portion 20A removably connected to an upper end of body portion 10A. The body portion 10A of the musical instrument is provided with an operation knob 15 arranged to draw a string 12 outwardly and provided therein with an electronic tone control of apparatus for control a musical tone or musical tone factors to be generated. The body portion 10A is further provided thereon with a series of tone-color control selectors 25A and a speaker 63. The neck portion 20A of the instrument is provided thereon with a series of fret switches 21A, a pitch-change mode selector 22A, a series of pitch-change selection switches 23A and a series of pitch adjustment selectors 24A. The component parts of the instrument are substantially the same in function as those of the musical instrument shown in FIG. 1. In this instrument, the body portion 10A of the instrument is composed of two body sections 10A-1 and 10A-2 which are separably assembled in a piece along line A—A in FIG. 17. When the instrument is brought by the player, the body section 10A-2 can be contained within the body section 10A-1, and the neck portion 20A can be inserted into the body section 10A-2 as shown in FIG. 18.

Figure 19:
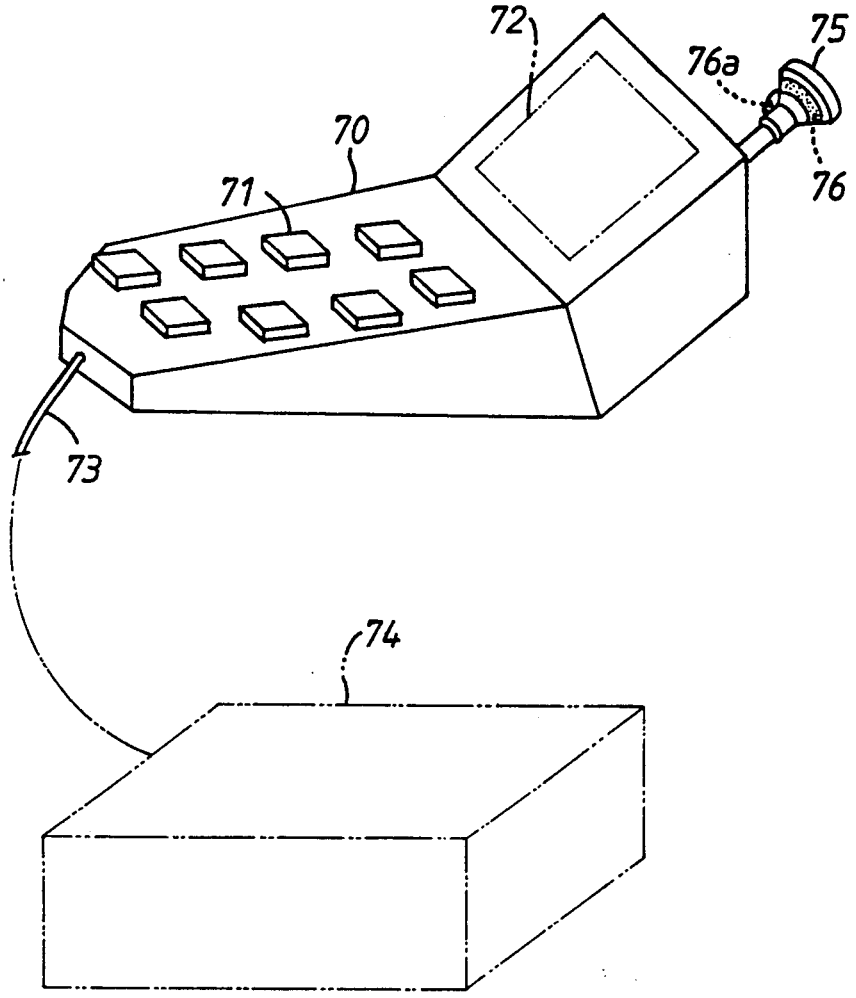
FIG. 19 is a perspective view of another modification of the musical instrument shown in FIG. 1.
Figure 20:
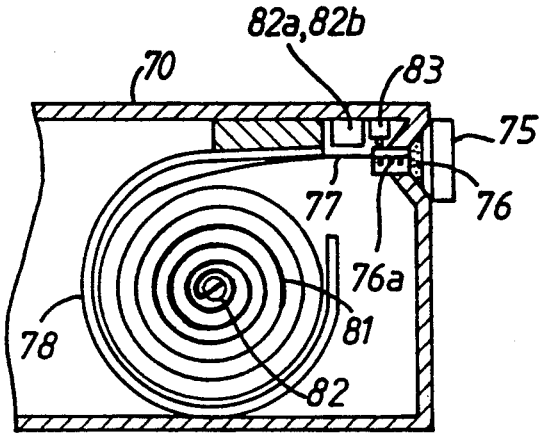
FIG. 20 is a sectional view showing an arrangement of a belt in a body portion of the instrument shown in FIG. 19.

4) As shown in FIG. 19, the musical instrument of FIG. 1 may be modified in the form of a small size portable box 70 which is provided thereon with a plurality of pitch selection selectors 71 and a series of tone-color selection selectors 72 for control of a tone color, a tone volume and sound effects or the like. The portable box 70 is provided therein with a plurality of detection switches (not shown) for detecting each operation of the selectors 71, 72. A musical tone generation box 74 is connected to the detection switches by mean of a cable 73 to be supplied with detection signals from the detection switches. The musical tone generation box 74 is provided therein with an electronic musical tone control apparatus which is substantially the same as that shown in FIGS. 11(*a*) and 11(*b*). In a further modification, the musical tone generation box 74 may be replaced with an electronic musical instrument with a key board assembly. In the portable box 70, an operation knob 75 is arranged to be operated by the player for drawing a flexible belt 77 contained within the portable box 70 as shown in FIG. 20. The operation knob 75 is provided with a pressure sensor 76 which is connected to the musical tone control apparatus through a lead wire 76*a*. As shown in FIG. 20, the flexible belt 77 is wound about a support shaft 82 along a semi-circular guide rail 78 mounted within the portable box 70. The support shaft 82 is fixedly mounted within the portable box 70 to support a spiral spring 81 thereon. The spiral spring 81 is fixed at its inner end to the support shaft 82 and connected at its outer end to an inner end of the flexible belt 77.

Figure 21A:
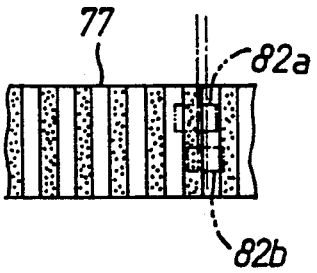
FIGS. 21(*a*) and 21(*b*) each are a plan view of a portion of the belt shown in FIG. 20.
Figure 21B:
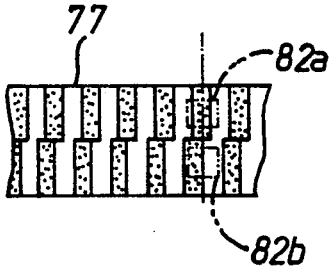

As shown in FIG. 21(*a*), the belt 77 is provided thereon with a striped pattern which faces pick-up devices 82*a*, 82*b* fixed to an upper internal surface of the protable box 70 at a different phase of 90 degree. The pick-up devices 82*a*, 82*b* each includes a light emitting element arranged to emit a beam toward the striped pattern of belt 77 and a light receiving element arranged to receive the beam reflected at the striped pattern of belt 77 for producing a sine wave signal similar to the output signal of pick-up coils 18*a*, 18*b* shown in FIG. 8. As shown in FIG. 21(*b*), the striped pattern of belt 77 may be replaced with two striped patterns at a different phase of 90 degree. In this case, the pick-up devices 82*a*, 82*b* are arranged on a common line. A detection switch 83 is further fixed to the upper internal surface of box 70 at a position adjacent the pick-up devices 82*a*, 82*b* to be closed when the operation knob 75 has been drawn into the portable box 70. The pick-up devices 82*a*, 82*b* and detection switch 83 are electrically connected to the musical tone control apparatus in box 74 through the cable 73. In the musical instrument shown in FIG. 19, the spiral spring 81 acts to apply a load on the flexible belt 77 when it has been drawn outwardly. The other function of the instrument is substantially the same as that of the musical instrument shown in FIG. 1.

5) The present invention may be adapted to a conventional electronic organ wherein the performance mechanism including the operation knob 15, string 11, gondola box 11 and pulleys 13, 17 and the detection circuit shown at a lower portion in FIG. 11(*b*) are housed within a body portion of the organ. The performance mechanism and detection circuit may be housed within a separate box in such a manner that output signals from the detection circuit are applied to the electronic organ.

6) The musical tone control apparatus may be adapted to percussion instruments such as a bongo, a tomtom, a cymbal, a timpano or the like for control of sound, tone-colors, tone volume, sound effects thereof. In the case of an electronic musical instrument arranged to sound cry voices of animals, the musical tone control apparatus may be adapted to control the tone pitch, tone color, tone volume or sound effect of the cry voices. In such a case, it is preferable that the fret switches 21*a*–21*f* and tone pitch selection selectors 71 are utilized to select the kinds of the musical tone and cry voices of the animals.

What is claimed is:

1. A musical tone control apparatus in an electronic musical instrument having a hollow body portion, comprising:

a flexible cord contained within the hollow body portion of said musical instrument to be drawn outwardly from a hole in a peripheral wall of said body portion;

loading means provided within the interior of said body portion to apply a load on said flexible cord for drawing it into said body portion;

an operation knob connected to an outer end of said flexible cord and being maintained in engagement with the hole of said body portion for restricting retraction of said flexible cord into the interior of said body portion against the load acting thereon;

detection means for detecting movement of said flexible cord caused by manipulation of said operation knob and for producing an electric signal indicative of the movement of said cord; and tone control means responsive to the electric signal from said detection means for controlling a musical tone or musical tone factors to be generated in accordance with the movement of said flexible cord.

2. A musical tone control apparatus as recited in claim 1, wherein said flexible cord has an inner end suspended from the peripheral wall of said body portion, and wherein said loading means comprises resilient means arranged to apply a load on an intermediate portion of said flexible cord.

3. A musical tone control apparatus as recited in claim 1, wherein said flexible cord has an inner end suspended from the peripheral wall of said body portion, and wherein said loading means comprises a gondola box having a pulley rotatably carried by said flexible cord and a spring connected at its one end to said gondola box and at its other end to the peripheral wall of said body portion for applying a load on said flexible cord.

4. A musical tone control apparatus as recited in claim 1, wherein said flexible cord has an inner end suspended from the peripheral wall of said body portion, and wherein said loading means comprises a pulley carried by said flexible cord and a spring having one end rotatably connected to said pulley and the other end connected to the peripheral wall of said body portion for applying a load on said flexible cord.

5. A musical tone control apparatus as recited in claim 1, wherein said flexible cord is wound about a support shaft mounted within said body portion, and wherein said loading means comprises a spiral spring fixed at its inner end to said support shaft and connected at its outer end to an inner end of said flexible cord for applying a load on said flexible cord.

6. A musical tone control apparatus as recited in claim 1, wherein said detection means comprises at least one of a first sensor arranged within said body portion to detect a displaced position of said flexible cord, a second sensor arranged within said body portion to detect a displacement speed of said flexible cord, and a third sensor arranged within said body portion to detect a displacement direction of said flexible cord.

7. A musical tone control apparatus as recited in claim 1, wherein the hollow body portion of said musical instrument has an elongated neck portion integrally provided at its upper end and is formed to be held by the player's legs.

8. A musical tone control apparatus as recited in claim 7, wherein said musical instrument is adapted to simulate a conventional stringed musical instrument, wherein the neck portion of said musical instrument is provided thereon with a plurality of fret switches which are vertically arranged in parallel to one another to correspond with strings of the conventional stringed musical instrument to be selectively operated by the player's finger for designating a desired scale of a musical tone to be generated, and wherein said tone control means includes a series of scale pitch signal generators cooperable with said fret switches for producing digital signals indicative of pitch data proportional to each pitch frequency of said fret switches in response to operation of said fret switches.

9. A musical tone control apparatus as recited in claim 8, wherein the neck portion of said musical instrument is further provided with a mode selector operable among a first position in which it acts to select a first mode for setting a desired scale of all musical tones to be generated, a second position in which it acts to select a second mode for uniformly changing the scales of all the musical tones by an adjusted pitch and a third position in which it acts to select a third mode for changing the respective scales of the musical tones by an adjusted pitch at each series of said fret switches.

10. A musical tone control apparatus as recited in claim 8, wherein the neck portion of said musical instrument is further provided with a series of pitch-change selectors cooperable with said mode selector for setting the desired scale of the musical tones respectively at said fret switches or changing the scale of the musical tones by an adjusted pitch in a condition where the third mode has been selected at said mode selector.

11. A musical tone control apparatus as recited in claim 9, wherein the neck portion of said musical instrument is provided with a series of pitch control tuners for controlling the pitch of the musical tones respectively at said fret switches in a condition where the third mode has been selected at said mode selector, and wherein said tone control means includes a series of pitch adjustment signal generators cooperable with said pitch control tuners for producing digital signals respectively indicative of an adjusted pitch in response to adjustment of said pitch control tuners.

12. A musical tone control apparatus as recited in claim 1 wherein the flexible cord is one of a string, a belt or a wire.

* * * * *